US005924750A

United States Patent [19]

Fuss et al.

[11] Patent Number: 5,924,750

[45] Date of Patent: Jul. 20, 1999

[54] DOOR OPENER

[75] Inventors: Fritz Helmut Fuss; Michael Holzer, both of Albstadt; Augustin Toma, Balingen, all of Germany

[73] Assignee: eff-eff Fritz Fuss GmbH & Co. Kommanditgesellschaft auf Aktien, Albstadt-Ebingen, Germany

[21] Appl. No.: 09/040,387

[22] Filed: Mar. 18, 1998

[30] Foreign Application Priority Data

Dec. 9, 1997 [DE] Germany ..... 197 54 658

[51] Int. Cl.[6] ..... E05C 3/06

[52] U.S. Cl. ..... 292/201; 292/341.16; 292/251.5

[58] Field of Search ..... 292/DIG. 24, 341.16, 292/341.15, 341.17, 201, 251.5, 244

[56] References Cited

U.S. PATENT DOCUMENTS

| | | | |
|---|---|---|---|
| 320,617 | 6/1885 | Blattman | 292/341.16 |
| 3,819,215 | 6/1974 | Fuss | 292/201 |
| 4,015,869 | 4/1977 | Horvath | 292/341.16 |
| 4,211,443 | 7/1980 | Butts et al. | 292/341.16 |
| 4,756,566 | 7/1988 | Logas | 292/341.16 |
| 4,815,776 | 3/1989 | Fuss | 292/341.16 |
| 4,986,584 | 1/1991 | Logas | 292/341.16 |
| 5,439,262 | 8/1995 | Fuss et al. | 292/341.16 |
| 5,490,699 | 2/1996 | Uyeda | 292/341.16 |
| 5,681,070 | 10/1997 | Williams et al. | 292/341.16 |
| 5,788,295 | 8/1998 | Fuss et al. | 292/341.16 |

*Primary Examiner*—Darnell M. Boucher
*Assistant Examiner*—John B. Walsh
*Attorney, Agent, or Firm*—Oblon, Spivak, McClelland, Maier & Neustadt, P.C.

[57] ABSTRACT

A door opener wich can be used for closed-circuit current operation as well as for working current operation, includes a door latch and a trimmer which can be moved for blocking and releasing the door latch, an armature which can be displaced for blocking or releasing the trimmer, an electromagnet for displacing the armature, whereby the armature can be moved between three consecutive armature positions, namely a first armature position, a second armature position, and a third armature position. The armature positions alternately provide a locking and releasing of the door latch. The door opener also includes a stop element, which can be displaced for delimiting the displacement path of the armature between a first stop position and a second stop position such that the first or third armature position is blocked.

20 Claims, 7 Drawing Sheets

DOOR OPENER

BACKGROUND OF THE INVENTION

1. Field of the Invention

The present invention is related to a door opener. More particularly, it relates to a door opener which can be used for closed-circuit current operation as well as for working current operation.

2. Discussion of the Background Art

A door opener of this kind is known, for example, from the U.S. patent application No. 08/808,161. This door opener can be used for closed-circuit operation as well as working circuit operation. In closed-circuit operation, the door latch is locked when a current flows through the electromagnet, and released when the current is switched off. In working current operation, the door latch is released when the current flows, while the door latch is locked when the current is switched off. The armature is movable between three consecutive positions placed in an order that corresponds to the series of conditions locked-released-locked or released-locked-released. However, the displacement path of the armature is delimited and selectively either the first or third stop position is blocked.

When there is a current flow through the electromagnet, the armature is either attracted toward the electromagnet or moves away from it. By selecting if the door latch is to be locked or released when the armature is attracted or moves away, the operation by means of a closed-circuit current or working current can be selected easily by displacing the stop element.

The electromagnet must be designed in such a way that the armature can move into all three positions, since otherwise a change from closed-circuit current operation to working current operation or vice versa would otherwise not be possible. This requires electromagnets with correspondingly large dimensions and capability. Such electromagnets are expensive and require door openers with sufficient space for installing the magnet.

SUMMARY OF THE INVENTION

The object of the invention is to provide a door opener that can be switched in a simple manner from working current operation to closed-circuit current operation and vice versa, and that has a compact and inexpensive construction.

According to the invention, it is provided that the electromagnet and the stop element are connected to each other and form a unit, that the unit can be moved for displacing the stop element into a first and second stop position, and that the armature is arranged between the electromagnet and the stop element and delimits the displacement path of the armature between the same.

A door opener of this kind, which can be used for closed-circuit current operation as well as for working current operation, comprises a door latch and a trimmer, which can be moved for blocking and releasing the door latch, an armature, which can be displaced for blocking or releasing the trimmer, an electromagnet for displacing the armature, whereby the armature can be moved between three consecutive armature positions, namely a first armature position, a second armature position, and a third armature position. The armature positions alternately provide a locking and releasing of the door latch. The door opener also includes a stop element, which can be displaced for delimiting the displacement path of the armature between a first stop position and a second stop position such that the first or third armature position is blocked.

A simple and smaller electromagnet can be used with a so-called attracting coil. It is also possible to utilize a so-called pushing electromagnet with an immersion piston, which has a relatively small working stroke. With an attracting electromagnet without immersion piston, the armature is moved under direct influence of the magnetic field. In this way, its capacity data and measurements can correspond to those of the electromagnet and can be used in a non-adjustable door opener.

An advantageous embodiment of the invention is characterized in that the electromagnet has a core with a pole surface that lies opposite to the stop element and delimits the displacement path of the armature in the manner of a stop. In this way, no further stop is required between the electromagnet and the stop element.

It is also advantageous that the stop element is shaped as a hook, whereby one free end of the stop element lies at a distance opposite to the electromagnet. Thereby, an especially simple and reliable delimitation of the displacement path of the armature is obtained between the electromagnet and the stop element.

Furthermore, it is advantageous to provide a displacement arrangement that makes it possible to displace and move the unit from outside of a housing. This also makes possible a typical position when the housing is closed. It is advantageous to arrange the displacement arrangement at one side of the housing, which is still accessible after the door opener has been installed. The displacement arrangement can have a positioning screw, for example, which displaces the unit by means of a coil. Another possibility consists in that a longitudinal hole with two rest positions is built into the housing of the door opener. A displacement arm that is coupled to the unit can be guided into the same. The rest positions of the longitudinal hole correspond to two stop positions, which can receive the unit. In this way, a preferred arrangement is provided, which makes it possible to rest or fix the displacement arrangement in the end positions of the longitudinal hole.

A particularly advantageous embodiment of the invention is characterized in that the electromagnet is arranged at one side of the armature, and in that the trimmer and the door latch are arranged essentially on another opposite-lying side of the armature. In this way, a particularly compact construction of the door opener is obtained, which allows an installation even in reduced space conditions.

It is also advantageous that the armature consists of two parts, an armature basic element and a vibration arm, whereby only the armature basic element grips into the trimmer, in that the armature basic element and the vibration arm can be rotated jointly in opposite directions around a common axis, and in that the vibration element is arranged between the electromagnet and the armature basic element. When an alternating current is applied to the electromagnet, a jammed armature basic element is shaken free. The armature basic element, which was retained at the trimmer due to a pressure force, is released by means of the reduced vibrations generated in this manner. For a desired effect of the force on the armature basic element in a determined direction, the vibration arm can have a hook, which grips under the armature basic element.

A particularly inexpensive embodiment of the door opener of the invention consists in that an attraction force in the direction toward the electromagnet can be generated when a current is supplied to the electromagnet, and in that a spring arrangement is provided, by means of which the armature is harnessed against the direction of the attraction force of the electromagnet.

BRIEF DESCRIPTION OF THE DRAWINGS

The invention is further described in the following with reference to the preferred embodiments shown schematically in the drawings, wherein.

DESCRIPTION OF THE PREFERRED EMBODIMENTS

Figures 1, 1A:
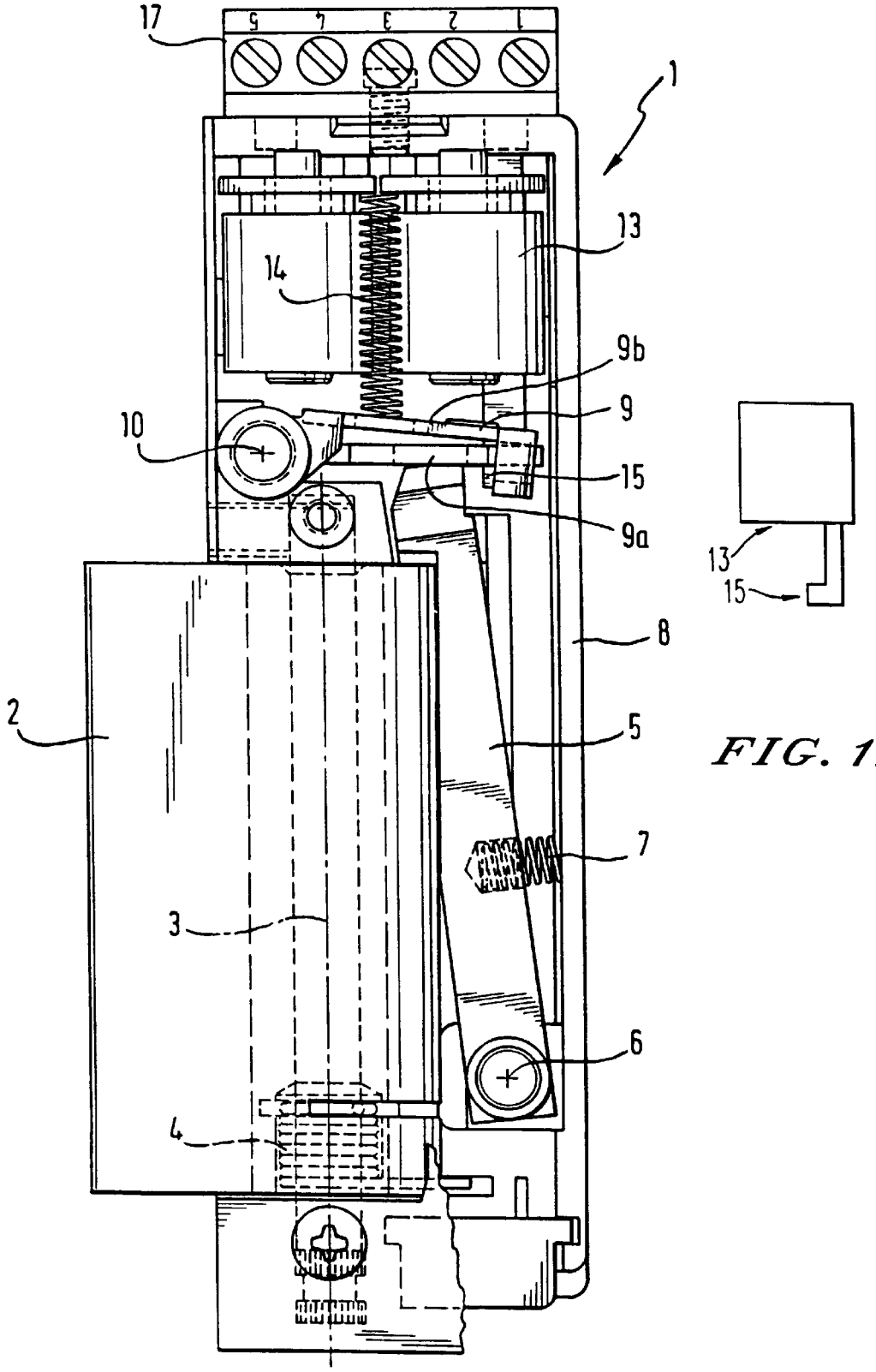
FIG. 1 is an elevation view of a door opener of the invention.
FIG. 1*a* is a side view of an electromagnet and a stop of the door opener shown in FIG. 1.

FIG. 1 shows an electric door opener 1 in side view, wherein a housing cover is almost completely removed. To provide a clear representation, only those door opener parts are shown and described which are in immediate connection with the development of the invention.

A door latch 2 is positioned so that it can be swivelled around a swivel axis 3 lying in the drawing plane and is harnessed by means of a spring 4 in a position that closes the door. The door latch 2 is contacted by a trimmer 5, whose swivel axis 6 runs vertical to the drawing plane. The trimmer 5 is harnessed against the door latch 2 by means of a trimmer spring 7, which leans against the door opener housing 8. The door latch 2 as well as also the trimmer 5 are slanted on the side whereby they come into contact with one another. In this way, when a door (not shown) is opened, the door latch 2 is swivelled around the swivel axis 3 in the opposite direction to the initial tension of the spring 4. Herewith, the door latch 2 comes into action with the trimmer 5, so that the same is swivelled around its swivel axis 6 against the door opener housing 8 in the opposite direction to the initial tension of the trimmer spring 7.

The trimmer 5 is blocked or released by an armature 9, which is positioned around the vertical swivel axis 10 vertical to the drawing plane. In this embodiment, the armature 9 represented in the drawing comprises an armature basic element 9*a* and a vibration arm 9*b*. If a high pressure is exerted on the door, and therefore on the door latch, this can lead to an inhibition or jamming of the armature basic element 9*a* and the trimmer 5. By supplying an alternating current to the electromagnet 13, the vibration arm 9*b* is moved back and forth in the interplay of the generated magnetic force and the spring force of a pretension spring 14 between the electromagnet 13 and the armature basic element 9*a*. In this manner, the armature basic element 9*a* can be released again even with a small magnetic force.

The basic element 9*a* is contacted by a pretension spring 14 fixed on the door opener housing 8 according to FIG. 1. The armature 9 is arranged between the electromagnet 13 and a stop element 15, which serve to delimit the displacement path of armature 9.

Figure 2:
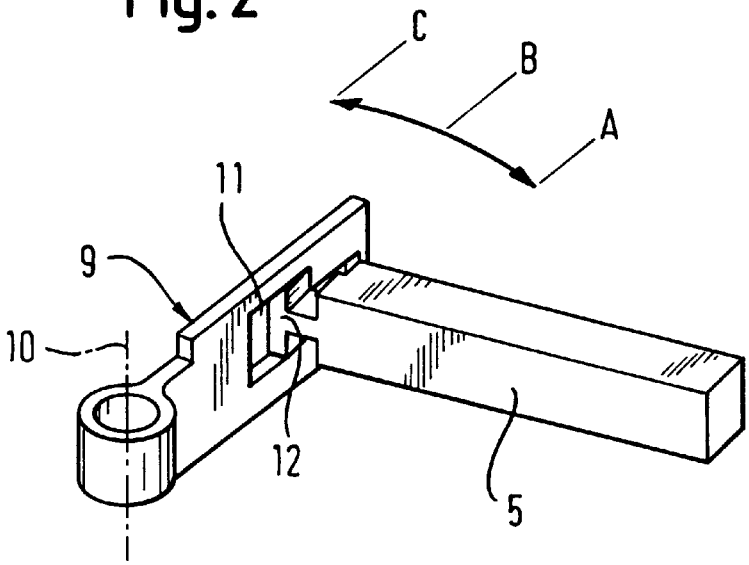
FIG. 2 is a detail view of the armature and trimmer of another embodiment of the invention.
Figure 3:
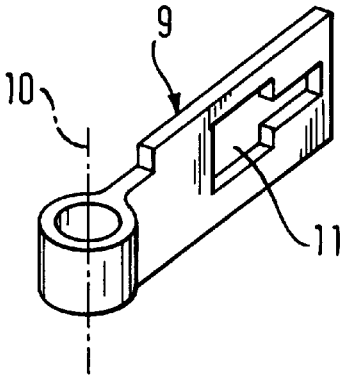
FIG. 3 is a separate view of the armature of FIG. 2.
Figure 4:
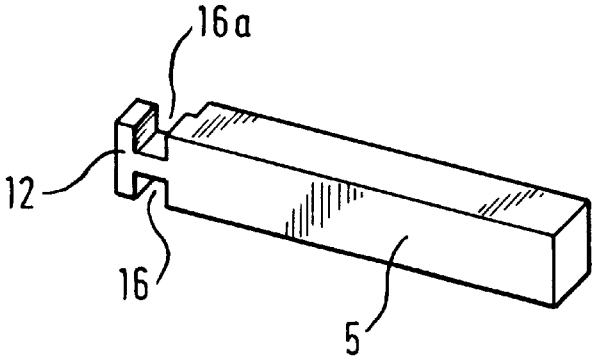
FIG. 4 is a separate view of the trimmer of FIG. 2.

The principle of interaction of the trimmer 5 and the armature 9 will be further explained in view of FIGS. 2, 3, and 4, whereby a locking or release of the door opener 1 is achieved. The armature can take on three positions with respect to the trimmer 5: released A—locked B—released C (FIG. 2).

An armature basic element 9*a* is shown separately in FIG. 3 and a trimmer 5 is shown separately in FIG. 4. A trimmer head 12 with an upper notch 16*a* and a lower notch 16 of the trimmer 5 engages with an indentation 11 of the element 9*a*. In the released positions A and C of FIG. 2, the trimmer 5 obtains freedom of movement. Of course, it is also possible to shape the element 9*a* and the trimmer 5 so that a first armature position, a second armature position, and a third armature position follow one another closely, whereby neighboring positions are arranged to be either locked or released depending upon another condition.

A closed-circuit current-working current switchover is obtained in that either the first released position A or the third released position C is blocked. For this purpose, the electromagnet 13 and the stop element 15 form a unit. The armature 9 is arranged between the electromagnet 13 and the stop element 15 and its displacement path is delimited between two armature positions. An adjustment between working current type and closed-circuit current type takes place according to the invention by displacing the unit formed by the stop element 15 and the electromagnet 13 between a first position and a second position, between which the unit can be moved.

Figure 5:
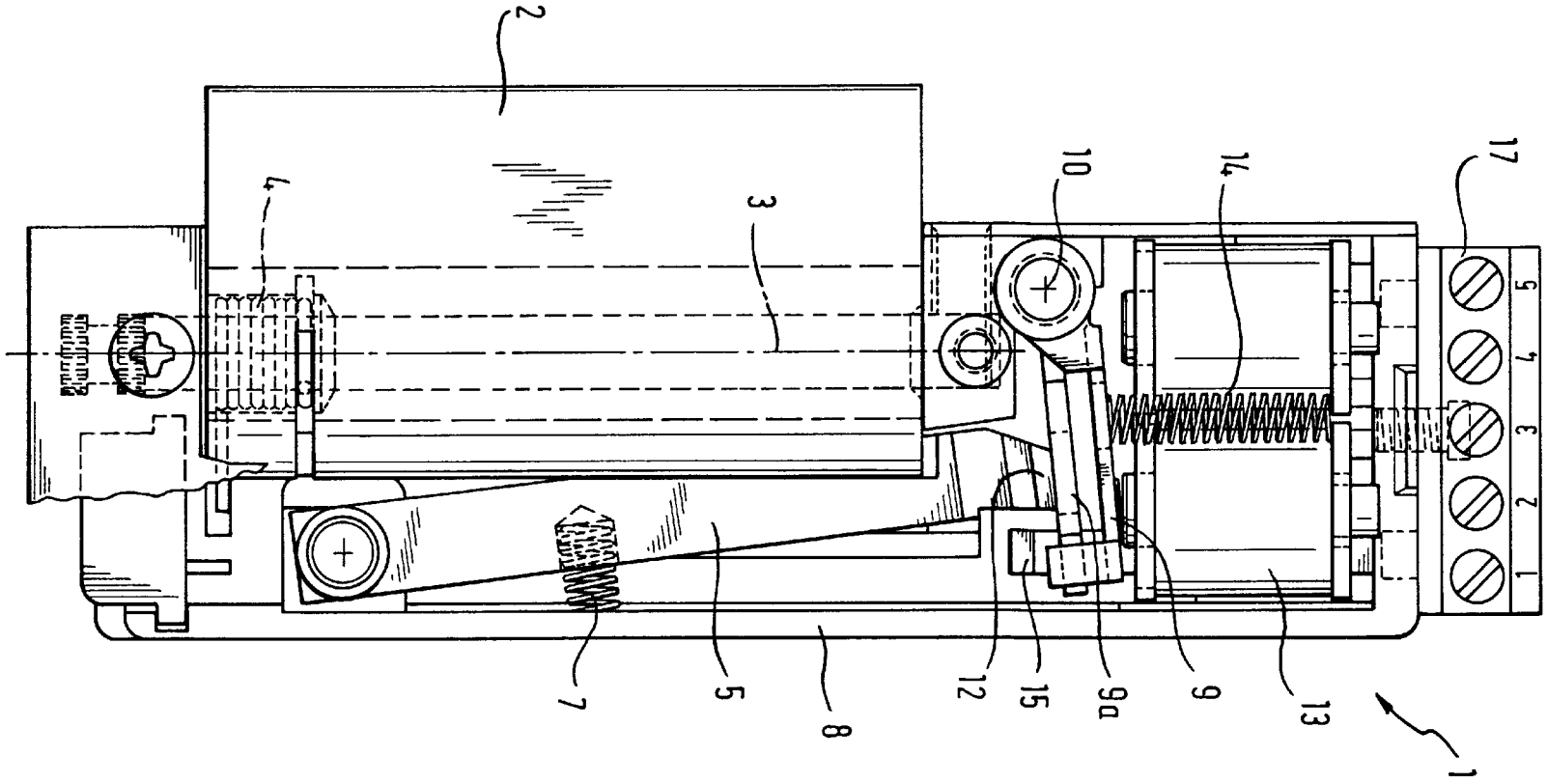
FIG. 5 is an exploded side view of a door opener of the invention in the working current mode with a current applied to the electromagnet.
Figure 6:
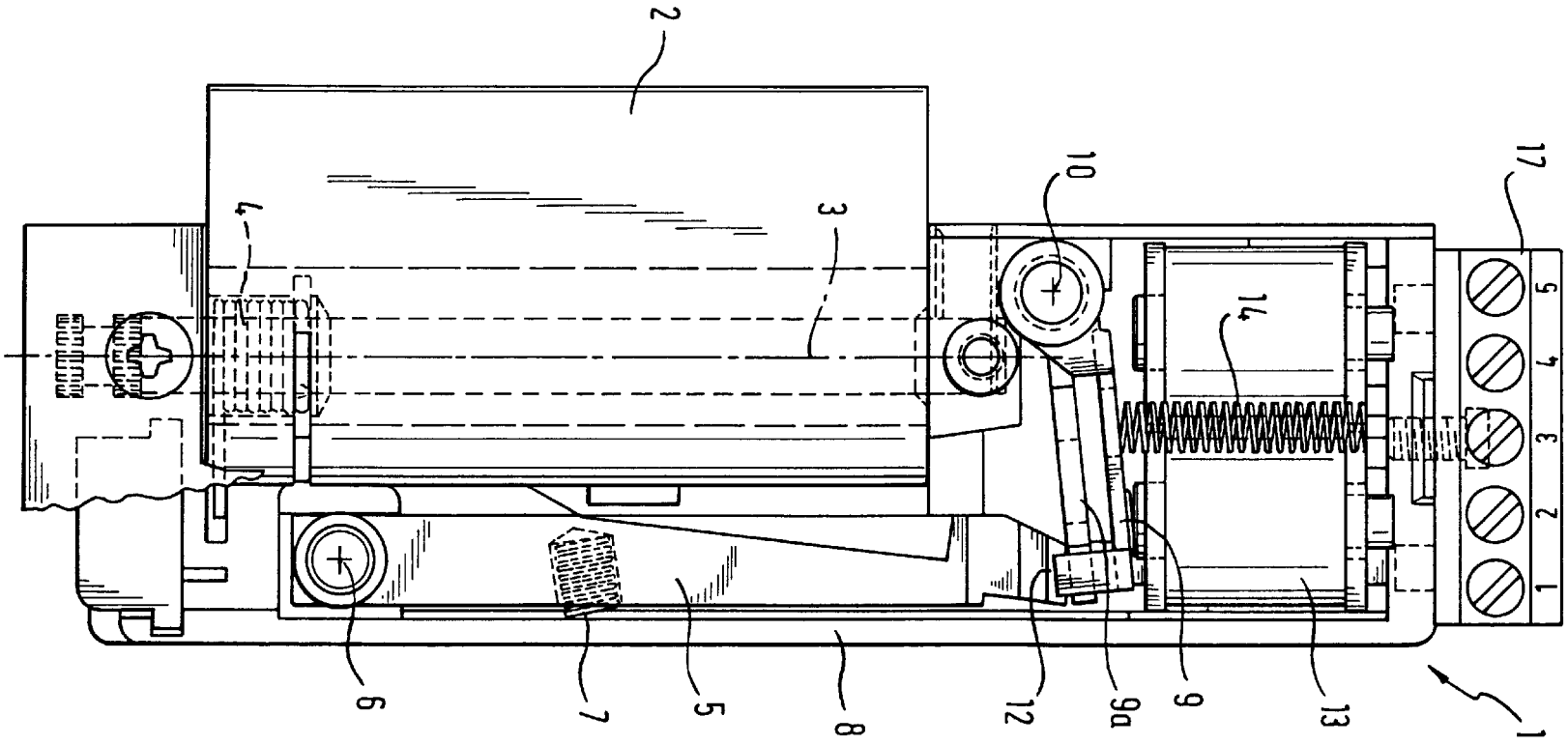
FIG. 6 shows the door opener of the invention according to FIG. 5 with retracted trimmer exposing or door latch.

FIGS. 1, 5, and 6 show a unit at an upper end position inside the door opener housing 8 in the vicinity of a clamping strip 17. The same serves to connect the required electric lines. In this way, the displacement path of the armature 9 is delimited at the positions C and B (FIG. 2). When no current flows through the electromagnet 13, the vibrator arm 9*b* and basic element 9*a* are pushed by the pretension spring 14 into the position B (locked) against the stop element 15. When current flows through the electromagnet 13, the vibrator arm 9*b* is attracted towards electromagnet 13, and thereby pulls basic element 9*a* into the position C (released), where vibrator arm 9*b* makes contact with a pole surface 13*a* of electromagnet 13. In this arrangement, the working current type of door opener is realized.

Figure 7:
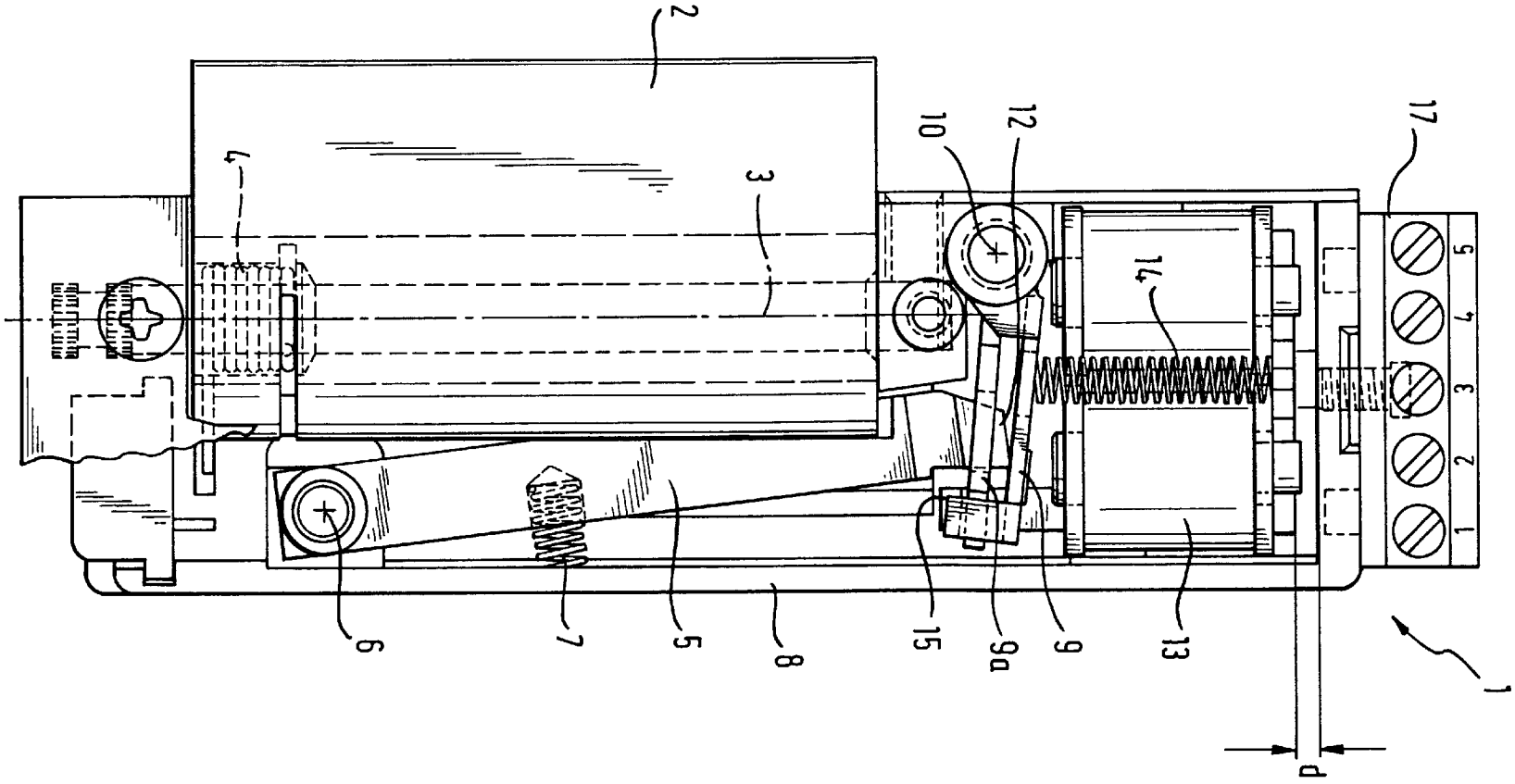
FIG. 7 shows the door opener of the invention according to FIG. 5 in the closed-circuit current mode with no current being supplied to the electromagnet.
Figure 8:
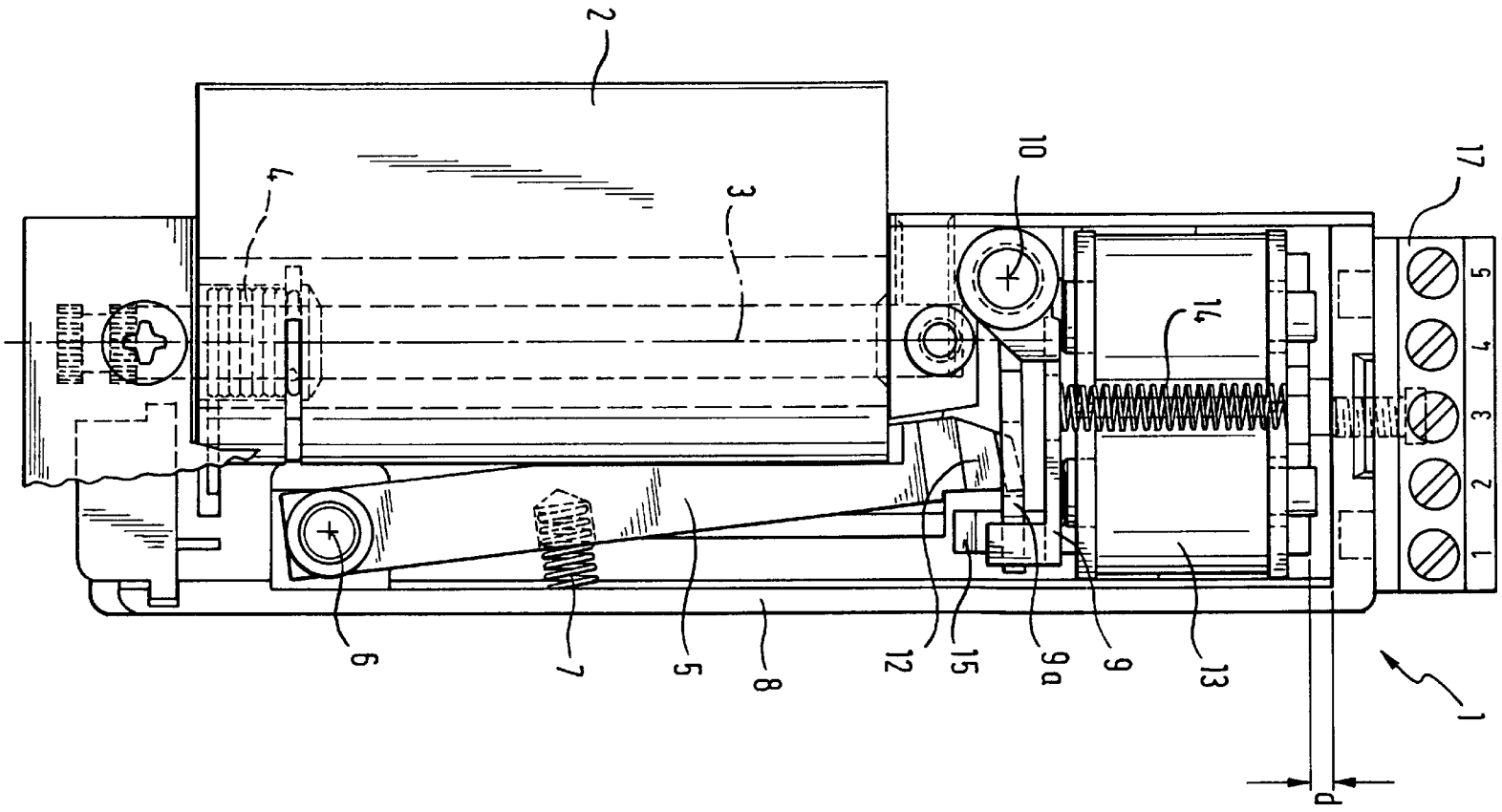
FIG. 8 shows the door opener of the invention according to FIG. 5 in the closed-circuit current mode with current being supplied to the electromagnet.
Figure 9:
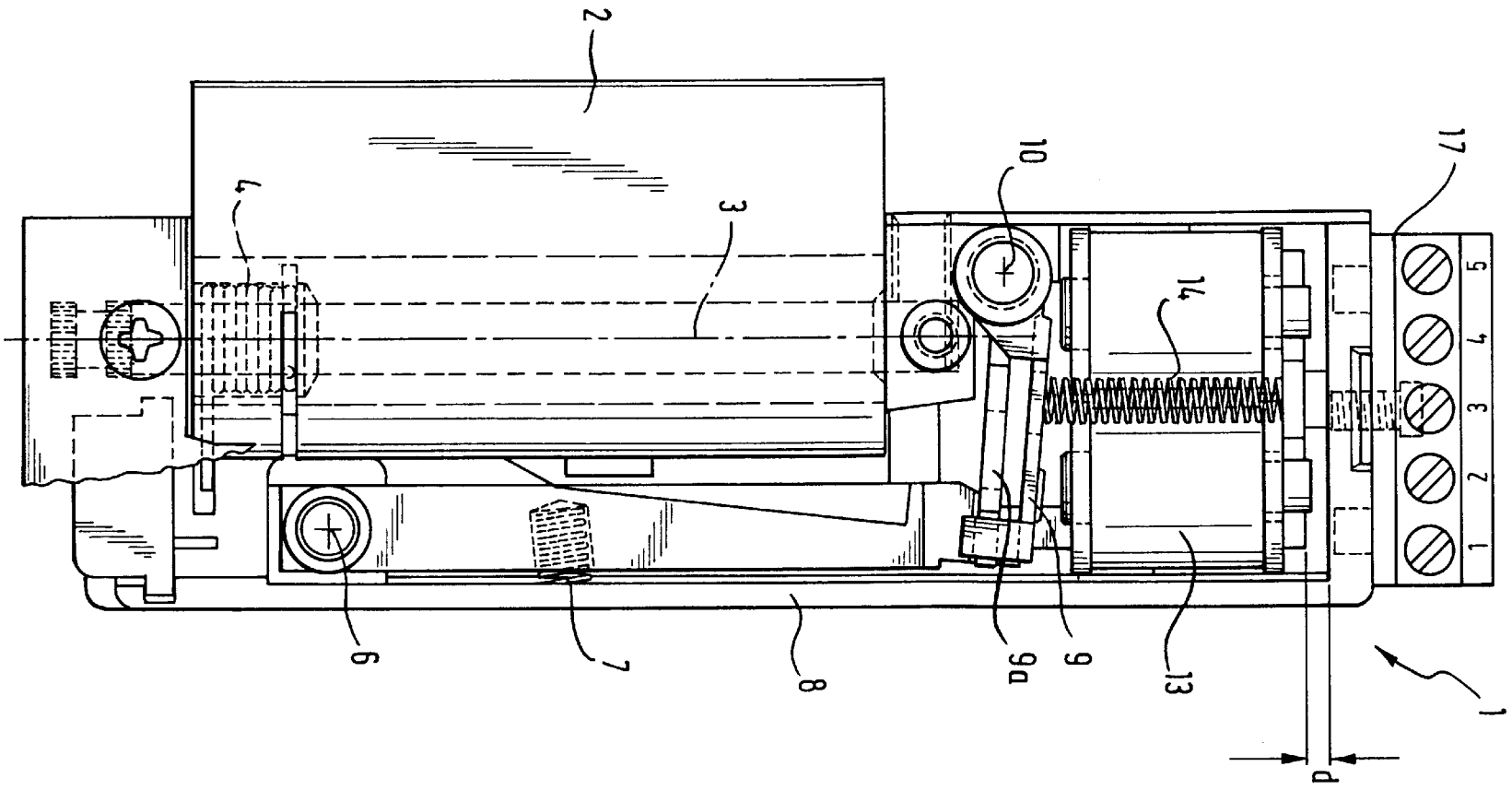
FIG. 9 shows the door opener of the invention according to FIG. 5 with retracted trimmer exposing the door latch.

In FIGS. 7, 8, and 9, the unit consisting of the electromagnet 13 and the stop element 15 is distanced by a distance d from the upper end of the door opener housing 8. In this manner, the armature basic element 9*a*, adjustable by means of the displacement path, is pushed from the positions C and B, as shown in FIGS. 1, 5, 6, to the positions B and A. With this, the door opener is released when the electromagnet has no current and is locked when the electromagnet 13 is supplied with current, which corresponds to the closed-circuit current type of door opener.

When the electromagnet 13 of the door opener in the working current mode shown in FIG. 1 is not supplied with current, the armature basic element 9*a* is positioned therefore in position B. When a current is supplied to the electromagnet 13, vibrator arm 9*b* is attracted in opposite direction to the force of the pretension spring 14, and thereby pulls armature basic element 9*a* toward the electromagnet 13 and into the position C, as shown in FIG. 5. The trimmer head 12 is located outside of the indentation 11 of the armature basic element 9*a*. In this way, the trimmer 5 can be moved against the force of the trimmer spring 7 towards the door opener housing 8 and thereby release the door latch 2, as represented in FIG. 6.

In FIG. 7, the door opener 1 is shown in the closed-circuit current mode. The unit consisting of the electromagnet 13 and the stop element 15 is displaced a distance d from the upper end of the door opener housing 8, in comparison with the door opener in the working current mode. In this way, the displacement path of the armature basic element 9*a* is limited to the positions B and A. In the condition shown in FIG. 7, the electromagnet 13 receives no current and the armature basic element 9*a* is therefore located in the position A, the trimmer 5 is movable, and the door opener 1 is unlocked. FIG. 8 shows the same door opener with the electromagnet 13 receiving current. The armature basic element 9*a* is pulled into the position B against the force of the pretension spring 14 and the door opener is locked. The same door opener is shown again in FIG. 9 with the electromagnet 13 not receiving current and showing the trimmer 7 in its position releasing the door latch 2.

What is claimed as new and desired to be secured by Letter Patent of the United States is:

1. A door opener comprising:

a door latch;

a trimmer, which can be moved for blocking and releasing the door latch;

an armature, which can be displaced for blocking or releasing the trimmer;

an electromagnet for displacing the armature, wherein the armature is movable between three consecutive armature positions, including a first armature position, a second armature position, and a third armature position, wherein at least one of the armature positions corresponds to the door latch being locked and at least one of the armature positions corresponds to the door latch being unlocked; and a stop element, wherein the electromagnet and the stop element are connected to each other and form a unit, wherein the armature is arranged between the electromagnet and the stop element such that the displacement path of the armature is delimited by the electromagnet and the stop element, and wherein said unit can be moved between a first and a second stop position thereby blocking the first or the third armature position.

2. A door opener according to claim 1, wherein the electromagnet has a core with a pole surface, which lies opposite to the stop element and thereby delimits the displacement path of the armature.

3. A door opener according to claim 1, wherein the stop element is hook-shaped and a free end of the stop element is positioned at a distance from the electromagnet.

4. A door opener according to claim 1, wherein a displacement arrangement is provided which can displace and fix the unit from the outside of the housing.

5. A door opener according to claim 1, wherein the electromagnet is arranged on a first side of the armature and wherein the trimmer and the door latch are arranged on a second side of the armature which is opposite the electromagnet.

6. A door opener according to claim 1, wherein the armature comprises an armature basic element and a vibration arm, whereby exclusively the armature basic element is in engagement with the trimmer, wherein the armature basic element and the vibration arm can be rotated in opposite directions around a common axis, and wherein the vibration arm is arranged between the electromagnet and the armature basic element.

7. A door opener according to claim 1, wherein an attraction force in the direction of the electromagnet can be generated by supplying current to the electromagnet, and wherein a spring is provided which biases the armature in the opposite direction of the attraction force of the electromagnet.

8. A door opener according to claim 2, wherein the stop element is hook-shaped and a free end of the stop element is positioned at a distance from the electromagnet.

9. A door opener according to claim 2, wherein a displacement arrangement is provided which can displace and fix the unit from the outside of the housing.

10. A door opener according to claim 3, wherein a displacement arrangement is provided which can displace and fix the unit from the outside of the housing.

11. A door opener according to claim 2, wherein the electromagnet is arranged on a first side of the armature and wherein the trimmer and the door latch are arranged on a second side of the armature which is opposite the electromagnet.

12. A door opener according to claim 3, wherein the electromagnet is arranged on a first side of the armature and wherein the trimmer and the door latch are arranged on a second side of the armature which is opposite the electromagnet.

13. A door opener according to claim 4, wherein the electromagnet is arranged on a first side of the armature and wherein the trimmer and the door latch are arranged on a second side of the armature which is opposite the electromagnet.

14. A door opener according to claim 2, wherein the armature comprises an armature basic element and a vibration arm, whereby exclusively the armature basic element is in engagement with the trimmer, wherein the armature basic element and the vibration arm can be rotated in opposite directions around a common axis, and wherein the vibration arm is arranged between the electromagnet and the armature basic element.

15. A door opener according to claim 3, wherein the armature comprises an armature basic element and a vibration arm, whereby exclusively the armature basic element is in engagement with the trimmer, wherein the armature basic element and the vibration arm can be rotated in opposite directions around a common axis, and wherein the vibration arm is arranged between the electromagnet and the armature basic element.

16. A door opener according to claim 4, wherein the armature comprises an armature basic element and a vibration arm, whereby exclusively the armature basic element is in engagement with the trimmer, wherein the armature basic element and the vibration arm can be rotated in opposite directions around a common axis, and wherein the vibration arm is arranged between the electromagnet and the armature basic element.

17. A door opener according to claim 5, wherein the armature comprises an armature basic element and a vibration arm, whereby exclusively the armature basic element is in engagement with the trimmer, wherein the armature basic element and the vibration arm can be rotated in opposite directions around a common axis, and wherein the vibration arm is arranged between the electromagnet and the armature basic element.

18. A door opener according to claim 2, wherein an attraction force in the direction of the electromagnet can be generated by supplying current to the electromagnet, and wherein a spring is provided which biases the armature in the opposite direction of the attraction force of the electromagnet.

19. A door opener according to claims 3, wherein an attraction force in the direction of the electromagnet can be generated by supplying current to the electromagnet, and wherein a spring is provided which biases the armature in the opposite direction of the attraction force of the electromagnet.

20. A door opener according to claims 4, wherein an attraction force in the direction of the electromagnet can be generated by supplying current to the electromagnet, and wherein a spring is provided which biases the armature in the opposite direction of the attraction force of the electromagnet.

* * * * *